United States Patent [19]

Perlino

[11] 3,930,454

[45] Jan. 6, 1976

[54] SMALL CLOTH VISE FOR A SEWING MACHINE

[75] Inventor: Silvano Perlino, Pavia, Italy

[73] Assignee: Necchi, Societa per Azioni, Pavia, Italy

[22] Filed: July 25, 1974

[21] Appl. No.: 491,697

[30] Foreign Application Priority Data

July 26, 1973 Italy ..... 42907/73

[52] U.S. Cl. ..... 112/121.12; 223/38

[51] Int. Cl.[2] ..... D05B 21/00

[58] Field of Search . 112/136, 153, 121.12, 121.15; 223/38

[56] References Cited

UNITED STATES PATENTS

| | | | |
|---|---|---|---|
| 2,453,623 | 11/1948 | Gilbert et al. | 223/38 |
| 3,093,275 | 6/1963 | Silverman | 223/38 |
| 3,483,834 | 12/1969 | Bennison | 112/121.15 |
| 3,517,630 | 6/1970 | Bennison et al. | 112/121.12 |
| 3,552,336 | 1/1971 | Brandriff et al. | 223/38 X |

*Primary Examiner*—H. Hampton Hunter

*Attorney, Agent, or Firm*—Stevens, Davis, Miller & Mosher

[57] ABSTRACT

A vise for sewing machines for sewing pockets on articles of clothing including a device for automatically folding edges of the material of the pocket and a plate for pressing the pocket material on the garment during the sewing operation. The plate consists of a central element shaped substantially like the pocket and three thin plates, two lateral and one on the bottom of what constitutes the pocket running parallel along the edges of the central element and capable of moving to the inside and outside of the central element parallel to its edges.

1 Claim, 3 Drawing Figures

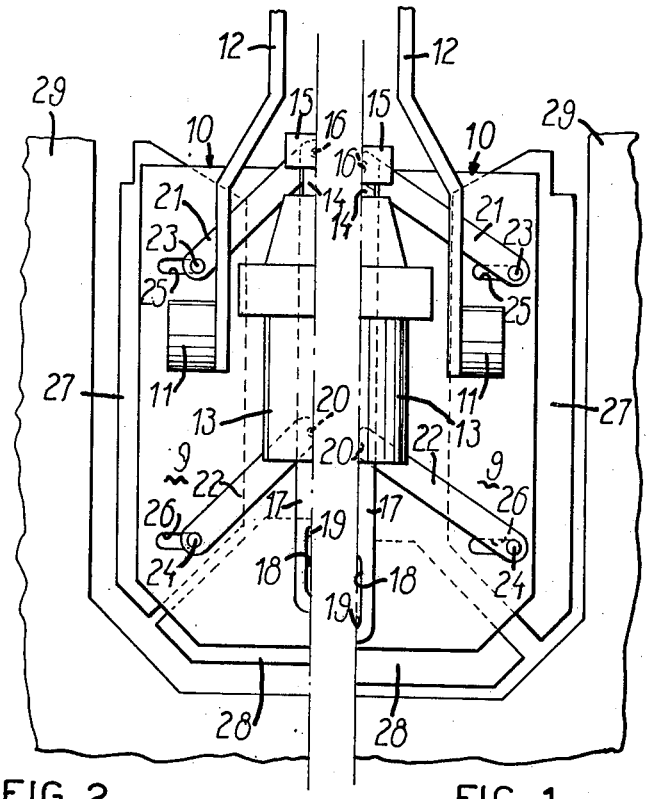
FIG. 2
FIG. 1
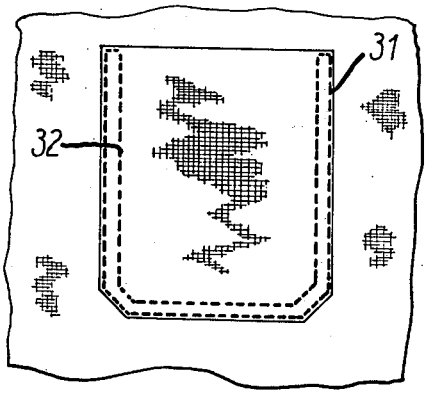
FIG. 3

SMALL CLOTH VISE FOR A SEWING MACHINE

The present invention relates to a small cloth vise in a sewing machine. The sewing machine is of the type described in U.S. Pat. No. 3,667,411 and has been studied for sewing small pockets on the front of shirts or on the rear of blue jeans. In this type of machine, a small working vise holds the material of the pocket on the garment after the edges have been folded over and is then moved by a suitable cam device to a position under the needle of the sewing machine along a trajectory corresponding to the course of the seam that is to be sewn.

The seam is made close to the outer edge of a plate of the small vise that is holding the pocket on top of the garment.

In the case of a single seam, there is no difficulty in holding the material in question since the seam is made very close to the outer edge of the holding plate keeping the pocket on the main piece of material. When two parallel seams are to be made to attach the pocket, the outermost seam is very difficult to sew, especially in the case of light materials, as the distance of the outer edge of the holding plate is too great to assure a good hold on the material, which during the sewing of the seam is stretched and deformed, thus compromising the perfect quality of the seam. The object of the present invention is to eliminate the problems mentioned above.

The technical problem to be solved is that of creating a holding plate for the pockets that will have an outer edge that is flexible, so that the two parallel seams can be sewn under identical and the most suitable conditions.

The solution to the technical problem is characterized by the fact that the plate consists of a central element substantially shaped like the pocket, and three thin plates, two lateral ones and one on the bottom, running parallel along the edges of the element and capable of deviating toward the inside and outside of this element, parallel to the edges.

Other advantages and characteristics of the invention will appear by reference to the accompanying drawings in which:

FIGS. 1 and 2 are the two symmetrical halves of the plate of the vise of the present invention in two different operating conditions, and FIG. 3 shows the course of the two parallel holding seams of the pocket on top of the garment.

In FIGS. 1 and 2, 10 represents the upper plate holding the pocket on the garment, which is hinged at 11 to two arms 12 of a support element, not shown, which controls the raising and lowering of the plate 10. The plate 10 consists of a central element 9, on which a pneumatic cylinder 13 is placed, on the end of the stem 14 of which a small block 15 is supported.

A platelet 17 is placed movably on the element 9 and is attached at one of its ends to the block 15 by means of a hinge 16. At the opposite end, it has a screw or buttonhole 18 intended to cooperate with the hinge 19 in the manner described in the following. On the plate 17, by means of the hinges 16 and 20, the levers 21 and 22 are supported, and are hinged at the other end to the hinges 23 and 24, which can run through the respective holes 25 and 26 formed in the central element 9 of the holding plate 10.

At the lower end of the hinges 23 and 24 are attached plates 27, placed symmetrically below the central element, along its lateral sections. A plate 28 placed below the central element 9 along its under side is guided, when necessary, onto this element and connected to the platelet 17 by means of a hinge 19 attached to it and coupled to a hole 18 formed longitudinally on the platelet 17.

The pocket that is to be sewn onto the garment after the edges are folded is brought into contact with the material onto which it is to be sewn and held in that position by the plate 10, by means of its sideplates 27 and 28, which are in the position illustrated in FIG. 1, very close to the metal plate 29 which, as illustrated in the patent, supports the elements for folding the edges of the pocket. In this position of the plates 27 and 28 the outermost seam is executed.

At the end of this seam 31, the pneumatic cylinder 13 is automatically activated, and its stem, from the position illustrated in FIG. 1 moves a certain distance to the position illustrated in FIG. 2. This movement of the stem 14 is transmitted to the platelet 17, which is also supported on it, and which moves the levers 21 and 22 and consequently the hinges 23 and 24 along the respective holes 25 and 26 toward the interior of the element 9.

The thin plates 27 are thus caused to move toward the inside of the element. At the same time, by its movement, the platelet 17 brings one end of its hole 18 into contact with the hinge 19 and thus pulls it along and the other thin plate 28 toward the inside of the element 9 in such a way that the plate 10 assumes the position illustrated in FIG. 2.

The outer edge of the plate 10 is now reduced in such a way that the seam 32 can be executed on the pocket under the same operating conditions under which the outer seam 31 was executed.

The needle of the sewing machine thus works on the material, in the case of both seams, in close proximity to the holding elements, i.e., the thin plates 27 and 28, which assure the conditions necessary for a good seam.

What is claimed is:

1. A device for holding the folded edge of a pocket against a garment during the sewing of two parallel seams along each of the folded edges of the pocket comprising a bottom plate for supporting the garment, a pivotable top assembly for pressing the pocket material on the garment during the sewing operation, said assembly consisting of a pivotal central plate taking the shape of the pocket and having slots therein, two movable side plates and a movable bottom plate positioned below the central plate and attached thereto, through said slots, said movable plates being capable of movement beyond and within the edges of the central plate, and means to move said movable plates, said means comprising a pneumatic motor positioned on said central plate, a movable platelet positioned above said central plate and attached to said bottom plate through one of said slots and to said motor, and pivotal levers each attached at one end to said platelet and at the other end to said side plates whereby said movable plates are moved inwardly toward said central plate after sewing the first seam and before securing the parallel second seam.

* * * * *